United States Patent [19]

Schindel

[11] 4,277,929

[45] Jul. 14, 1981

[54] GRIPPING HEAD FOR SCREWING ON A THREADED CLOSURE

[75] Inventor: Hugo Schindel, Saulheim, Fed. Rep. of Germany

[73] Assignee: Rationator-Maschinenbau GmbH, Hillesheim, Fed. Rep. of Germany

[21] Appl. No.: 102,748

[22] Filed: Dec. 12, 1979

[30] Foreign Application Priority Data

Jan. 10, 1979 [DE] Fed. Rep. of Germany ..... 2900713

[51] Int. Cl.[3] ..... B67B 3/20; B65B 7/28

[52] U.S. Cl. ..... 53/331.5

[58] Field of Search ..... 53/331.5, 317, 361, 53/334

[56] References Cited

U.S. PATENT DOCUMENTS

| | | | |
|---|---|---|---|
| 2,891,366 | 1/1959 | Stover | 53/361 |
| 3,255,568 | 6/1966 | Martin et al. | 53/331.5 X |
| 3,405,499 | 10/1968 | Dexter | 53/331.5 |
| 3,435,587 | 4/1969 | Weller | 53/331.5 X |
| 3,905,177 | 9/1975 | Herzog | 53/317 X |

*Primary Examiner*—Horace M. Culver

*Attorney, Agent, or Firm*—Kurt Kelman

[57] ABSTRACT

In a machine for screwing a threaded closure on a threaded neck of a container: a gripping head mounted on the machine frame, the gripping head comprising a pair of spaced-apart gripping spindles rotatably mounted in the machine frame, each gripping spindle having a clamping head including a radially convex membrane, the membranes being arranged and spaced for gripping the closure therebetween, and a drive spindle mounted between the gripping spindles.

2 Claims, 1 Drawing Figure

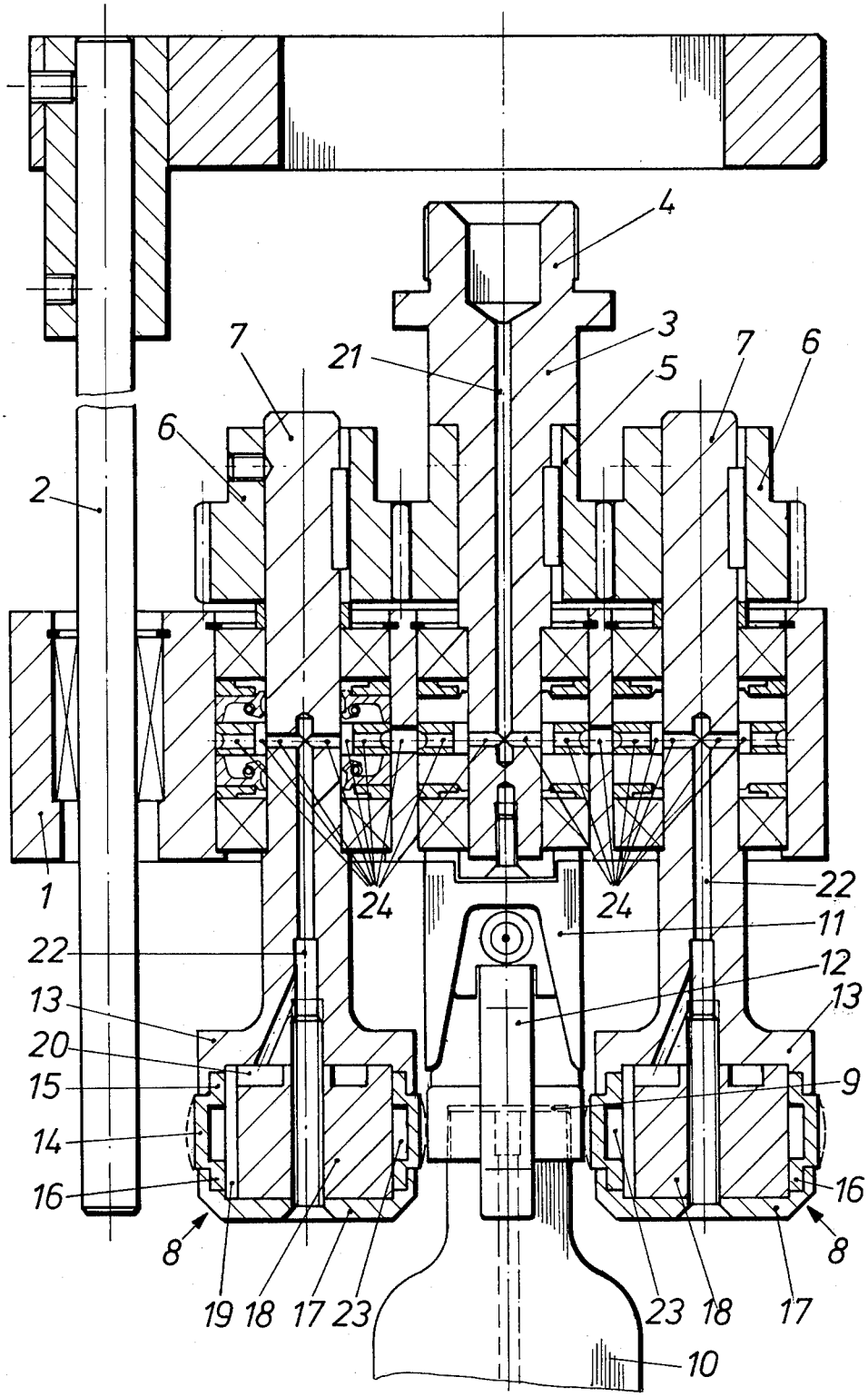
4
3
7
21
5
7
6
6
2
1
24
24
22
11
22
12
13
13
20
15
9
14
16
16
8
8
19 18 17 23
23 18 17
10

GRIPPING HEAD FOR SCREWING ON A THREADED CLOSURE

The present invention relates to machines for screwing a threaded closure on a threaded neck of a container, and more particularly to a gripping head mounted on the frame of such a machine. Threaded closures which may be screwed on by the gripping head of this invention include especially spray valves comprising a fixed upper part and a rotatable lower part.

Conventionally, spray valves of this somewhat complex type have been mounted on bottles manually by an operator placing the bottles on a turntable and then screwing on the closure by hand. This requires considerable time and labor is not readily available for this type of work. In addition, the tightness of the closure is left to the feeling of the operator so that the bottles often are not tightly closed. Efforts to mechanize this operation include an apparatus wherein pairs of cooperating friction wheels are mounted in the conveyor path of the bottles. The bottles with the closures are moved between the friction wheels which are spring-biased against each other to grip the closures. The friction wheels must run at a high rotary speed since the closures are held only briefly between the wheels. Even at high rotary speeds, it is not always possible to screw on the closures tightly during the brief period of time they are clamped between the friction wheels and, furthermore, the high rotary speed causes damage to the closures. It is impossible to exert a uniform, constant torque since each friction wheel has its own friction coupling. In addition, the structure is relatively complex and correspondingly expensive.

It is the primary object of the invention to provide a gripping head which enables complex closures to be screwed on securely, dependably and without damage to the closures.

The above and other objects are accomplished according to the present invention with a gripping head comprising a pair of spaced-apart gripping spindles rotatably mounted in the machine frame, each gripping spindle having a clamping head including a radially convex membrane, the membranes being arranged and spaced for gripping the closure therebetween, and a drive spindle mounted between the gripping spindles.

In a gripping head of this type, there is no friction between the fixed part of the closure and the clamping head which effects the screwing-on operation so that damage to the closure is excluded. The required torque can be adjusted on a single conventional coupling between the drive spindle and the gripping spindles so that the required torque may be accurately set for each type of screw-on closure. Another considerable advantage resides in the fact that the clamping heads may be mounted on existing machines with rotatable spindles, thus saving the cost of new machinery. The clamping heads may be readily replaceably mounted and such replacement does not require skilled labor. Despite the simplicity and corresponding low cost of the apparatus, it may be used for screwing on even very complex closures. In addition, the membranes of the clamping heads may be resiliently pressed into gripping engagement with the closures by a pressure fluid medium, such as air, thus avoiding the use of mechanical biasing means, such as springs.

The above and other objects, advantages and features of this invention will become more apparent from the following detailed description of a now preferred embodiment thereof, taken in conjunction with the single FIGURE of the accompanying drawing showing an axial section of the apparatus.

As illustrated, a machine for screwing internally threaded closure 9 on an externally threaded neck of container 10 has frame 1 pivotally mounted on machine shaft 2 for swinging machine frame 1 in a substantially horizontally plane into selected operating positions. The gripping head of the invention comprises a pair of spaced-apart gripping spindles 7, 7 rotatably mounted in machine frame 1 and drive spindle 3 mounted between the gripping spindles. The drive spindle may be screwed with its end portion 4 on an existing spindle in the machine frame and has a drive pinion 5 meshing with pinions 6, 6 on gripping spindles 7, 7 to rotate the gripping spindles on rotation of the drive spindle. Each gripping spindle has clamping head 8 arranged at a lower end thereof. The clamping head includes radially convex membrane 14, the membranes of the two clamping heads being arranged and spaced for gripping rotatable closure 9 therebetween. Machine frame 1 further carries vise 11 mounted in vertical alignment with fixed upper part 12 of the illustrated spray valve to hold this part stationary while lower closure part 9 is rotated to screw the closure on the bottle neck.

In the preferred illustrated embodiment, clamping head 8 comprises cup-shaped carrier part 13 and membrane 14 is an annular element of U-shaped cross section fitted into the annular rim of the carrier part and defining an annular chamber for receiving a pressure fluid medium, such as air. The gripping spindle defines conduit means including axially extending bore 22 for delivering the pressure fluid medium to the annular chamber for pressing elastic membrane 14 radially outwardly (see broken lines) into gripping engagement with closure 9. Clamping head 8 further comprises support roller 18 mounted inside annular membrane element 14 and having substantially the same height, the support roller including radial spacing ribs 20 and axial spacing ribs 19 between the annular membrane element and the carrier part, respectively. The illustrated clamping head finally comprises clamping disc 17 clamping the annular membrane element and the support roller to the carrier part. As shown, radially convex membrane 14 has respective annular flanges 15 and 16 fitting respectively into cup-shaped carrier part 13 and clamping disc 17, the flanges, carrier part and clamping disc being threadedly connected, if desired, so that the clamping head may be readily disassembled and the membrane replaced.

Axially extending bore 22 leads into channels defined between spacing ribs 19, and 20 so that elastic membrane 14 may be outwardly pressed when a pressure fluid medium is delivered thereto through these channels, thus gripping closure 9 placed between the two clamping heads. The pressure fluid medium is delivered through axial bore 21 in drive spindle 3 and transversely extending conduit means 24 connecting axial bore 21 in the drive spindle to axially extending bores 22 in the gripping spindles. As shown, suitable gaskets are provided to seal the connecting conduits and prevent escape of pressure fluid medium.

What is claimed is:

1. In a machine for screwing a threaded closure on a threaded neck of a container, the machine having a frame: a gripping head mounted on the machine frame, the gripping head comprising a pair of spaced-apart gripping spindles rotatably mounted in the machine frame, each gripping spindle having a clamping head comprising a cup-shaped carrier part and including a radially convex membrane, the membranes being arranged and spaced for gripping the closure therebetween, each membrane being an annular element of U-shaped cross section defining an annular chamber for receiving a pressure fluid medium, each gripping spindle defining conduit means for delivering the pressure fluid medium to the annular chamber for pressing the membrane radially outwardly into gripping engagement with the closure, and the clamping head further comprising a support roller mounted inside the annular membrane element and having substantially the same height, the support roller including radial and axial spacing ribs between the annular membrane element and the carrier part, respectively, and a clamping disc clamping the annular membrane element and the support roller to the carrier part, and a drive spindle mounted between the gripping spindles.

2. In the machine of claim 1, wherein the conduit means for delivering the pressure fluid medium includes an axially extending bore in the gripping spindle, the bore leading into channels defined between the spacing ribs, and further comprising an axial bore in the drive spindle and transversely extending conduit means connecting the axial bore in the drive spindle to the axially extending bore in the gripping spindle.

* * * * *